US008579698B2

(12) United States Patent
Mourad

(10) Patent No.: US 8,579,698 B2
(45) Date of Patent: Nov. 12, 2013

(54) MULTI-SPIN AND WAGER SLOT VIDEO MACHINE

(76) Inventor: Raphael Mourad, Thornhill (CA)

( * ) Notice: Subject to any disclaimer, the term of this patent is extended or adjusted under 35 U.S.C. 154(b) by 0 days.

(21) Appl. No.: 13/428,261

(22) Filed: Mar. 23, 2012

(65) Prior Publication Data

US 2013/0252698 A1 Sep. 26, 2013

(51) Int. Cl.
*A63F 9/24* (2006.01)

(52) U.S. Cl.
USPC ..... 463/20

(58) Field of Classification Search
USPC ..... 463/20
See application file for complete search history.

(56) References Cited

U.S. PATENT DOCUMENTS

| | | | | |
|---|---|---|---|---|
| 5,720,662 | A * | 2/1998 | Holmes et al. | 463/20 |
| 6,033,307 | A * | 3/2000 | Vancura | 463/20 |
| 6,270,412 | B1 * | 8/2001 | Crawford et al. | 463/20 |
| 6,413,162 | B1 * | 7/2002 | Baerlocher et al. | 463/20 |
| 7,753,773 | B2 * | 7/2010 | Baerlocher et al. | 463/20 |
| 2005/0009597 | A1 * | 1/2005 | Daly | 463/20 |
| 2005/0056996 | A1 * | 3/2005 | Nordman | 273/143 R |
| 2005/0101379 | A1 * | 5/2005 | Falconer | 463/25 |
| 2006/0116195 | A1 * | 6/2006 | Baerlocher et al. | 463/20 |
| 2006/0160595 | A1 * | 7/2006 | Gerson et al. | 463/16 |
| 2007/0010316 | A1 * | 1/2007 | Baerlocher et al. | 463/20 |
| 2010/0234092 | A1 * | 9/2010 | Gomez et al. | 463/20 |
| 2010/0252997 | A1 * | 10/2010 | Walker et al. | 273/292 |
| 2012/0115577 | A1 * | 5/2012 | Kaneko | 463/20 |
| 2012/0202579 | A1 * | 8/2012 | Olsen | 463/20 |

OTHER PUBLICATIONS

Bueschel, Richard M., "Lemons, Cherries, and Bell-Fruit-Gum", 1995, which includes the brochure "Double or Nothing" by Bally Distributing Company, approx. 1975 on p. 267.*

Fey, Marshall "Bally Slot Machines" Revised 3rd Edition, Liberty Belle Books, which includes the brochure "Lucky Twins Continental" by Bally, 1972, on p. 26.*

* cited by examiner

*Primary Examiner* — Pierre E Elisca
(74) *Attorney, Agent, or Firm* — Gifford, Krass, Sprinkle, Anderson & Citkowski, P.C.

(57) ABSTRACT

A video slot machine allows a player to make a plurality of wagers at the beginning of the game. The machine has a plurality (R) of reels which may be either mechanical or video. Each reel may have S symbols. The first wager made by the player is on the outcome of the spin of the first set of reels, a second wager is on the combined outcome of the first and second sets of the reels, etc. until the last wager is on the combined outcome of all of the reels. If a predetermined condition is met on the outcome of each spin, the subsequent spin is enabled. If at any spin the predetermined condition for that spin is not met, then the subsequent wagers are canceled and credited back to the player. The payout ratio increases for each subsequent spin in the series.

5 Claims, 2 Drawing Sheets

R = 5
N = 5
r(1) = 1
r(2) = 1
r(3) = 1
r(5) = 1

R = 5
N = 3
r(1) = 2
r(2) = 2
r(3) = 1

MULTI-SPIN AND WAGER SLOT VIDEO MACHINE

FIELD OF THE INVENTION

This invention relates to video slot machines and more particularly to such machines which enable a player to make a plurality of wagers before the first spin of the machine with subsequent spins only being enabled based on conditions being met by the previous spin and the payout ratio increasing with each spin.

BACKGROUND OF THE INVENTION

This invention relates to video slot machines with a new concept of machine design, activation, wagers placed and progressive payouts.

Video slot machines are the most popular games at casinos. In general, a gaming machine allows a player to play a game in exchange of a single wager. Players bet a single wager and either pull a lever or push a button to activate the machine. The slot video machine either mechanically spins a plurality of reels or electronically displays rotating reels. The machines usually have between three and five reels, each having a variety of symbols along their outer circumference. Players win or lose depending on the symbols type and position of all the reels on the screen. In most cases, players win or lose depending on how many of the reels resulted in matching symbols and the winning amount depends on which symbols are matched. In the last few decades, machines have been developed with many different features to captivate and increase a player's interest. Among these features, machines are provided with flashing displays, lighted displays, sound effect, awards, prizes, progressive jackpots, reward of feature games of different types, multi-line gaming and simultaneous multi-play presentation.

However, constant play on a particular type of machine tends to dull the player's interest in the game and accordingly the industry is compelled to continually introduce new variations of the machines to maintain the player's interest.

SUMMARY OF THE INVENTION

Accordingly, the present invention is directed to a unique video slot machine game that broadly allows the player to make a series of wagers before the initiation of play on the outcome of spins of the reels. The initial wager is on a conventional spin of a first subset of the reels and the subsequent wagers are only allowed depending upon the outcome of previous wagers and are on the combined outcome of the previous reel spins. Preferably the series of wagers provide increased payout ratios and the results of the previous wager or wagers determine whether subsequent spins may be engaged in. If the condition allowing subsequent wagers is not met at any stage, the wagers which the player initially made on subsequent stages are credited back to the player, the machine resets, and a new round starts.

In accordance with one aspect of the invention, a wagering game includes a plurality of indicia-bearing reels, say R reels with S symbols on each reel. At the start, the player bets N wagers: a first wager W(1) on the outcome of the spin of the first subset of r(1) reels, a second wager W(2) on the combined outcome of the first and second subsets of r(1)+r(2) reels, a third wager on the combined outcome of the first, second and third subsets of reels, . . . and this continues till the last Nth wager on the combined outcome of all the R reels. As the player activates the machine by pulling a lever or pushing a spin button, the first subset of (1) reels spin, stop and display symbols on the screen. Depending on the type and position of the symbols displayed on the screen, the machine displays if the player has won or lost and if won, the winning amount is credited to the player. If a predetermined condition is met on the outcome of the first spin of the first r (1) reels, such as the player winning that wager, a second set subset of r(2) reels spin, stop and symbols are displayed. Depending on the type and position of the symbols displayed on the r(1)+r(2) reels combined, the machine displays whether the second wager is a win or a loss, and if former, then the winning amount is credited to the player. This process continues till the last subset of reels. At any spin n, if the predetermined condition is not met, then the n+1 subset of reels are not spun and all wagers beyond that spin are credited back to the player. At each spin, the machine pays winning wagers according to a predetermined payout schedule or collects losing wagers associated with reels that spun. Payouts are progressive, i.e. payout ratio increase with the number of spins.

These aspects and more, which are unique in their concept and their incorporation in the slot video machines, will provide enhanced entertainment and a unique experience to the players which will become apparent to those skilled in the art from this disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration purpose only and do not limit the invention as defined in the claims.

Figure 1:
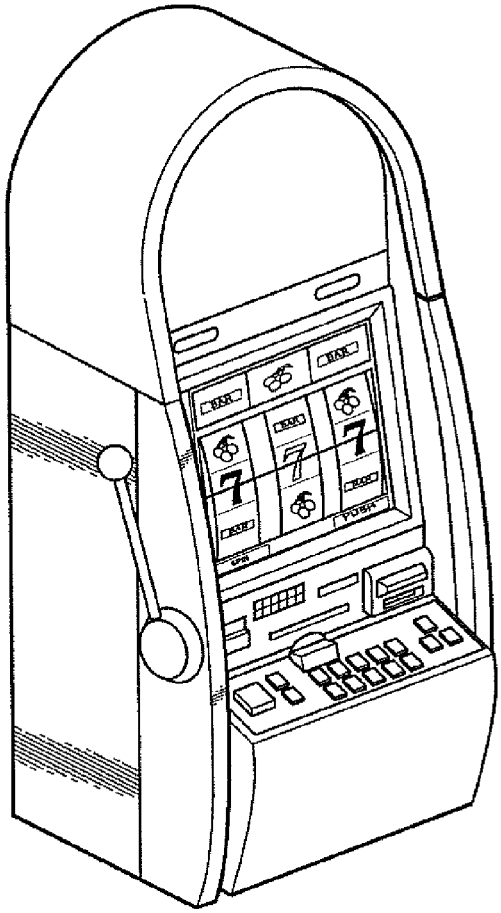
FIG. 1 is an illustration of a standard slot video machine illustrated as having three reels that can be used in the present invention.
Figure 2:
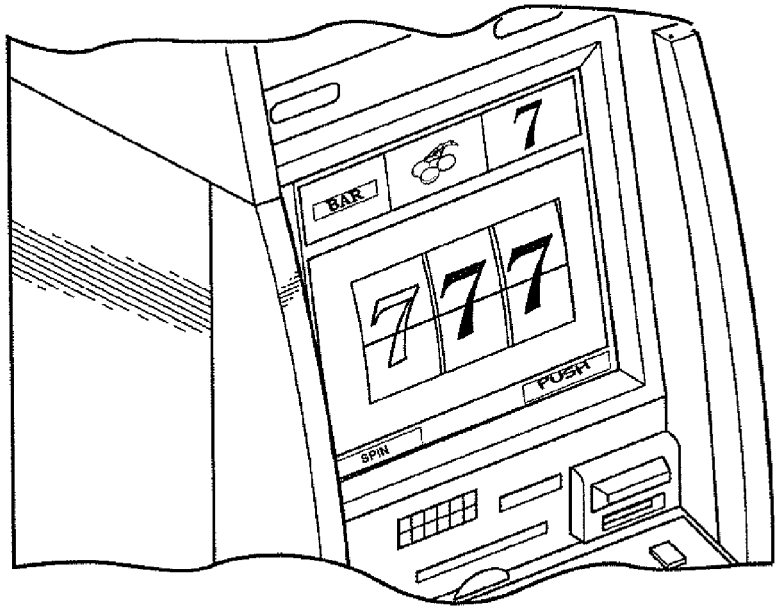
FIG. 2 is a detailed view of a typical reel combination produced in the machine of FIG. 1.

A preferred embodiment may be implemented in a basic slot machine as illustrated in FIG. 1, but with five reels. The operation of the machine is controlled by a microprocessor under the control of an application program. The microprocessor receives signals from entries that the player makes on a control panel 30. These entries include credits from coin/bill/player ID and credit card insertion slots and the like, and wagers. The microprocessor, under control of the application program, controls the spin of mechanical reels or generates displays of reel rotation on LCDs or the like. It also generates display messages related to prompts to the player, win/loss messages, available credit and the like.

Figure 3:
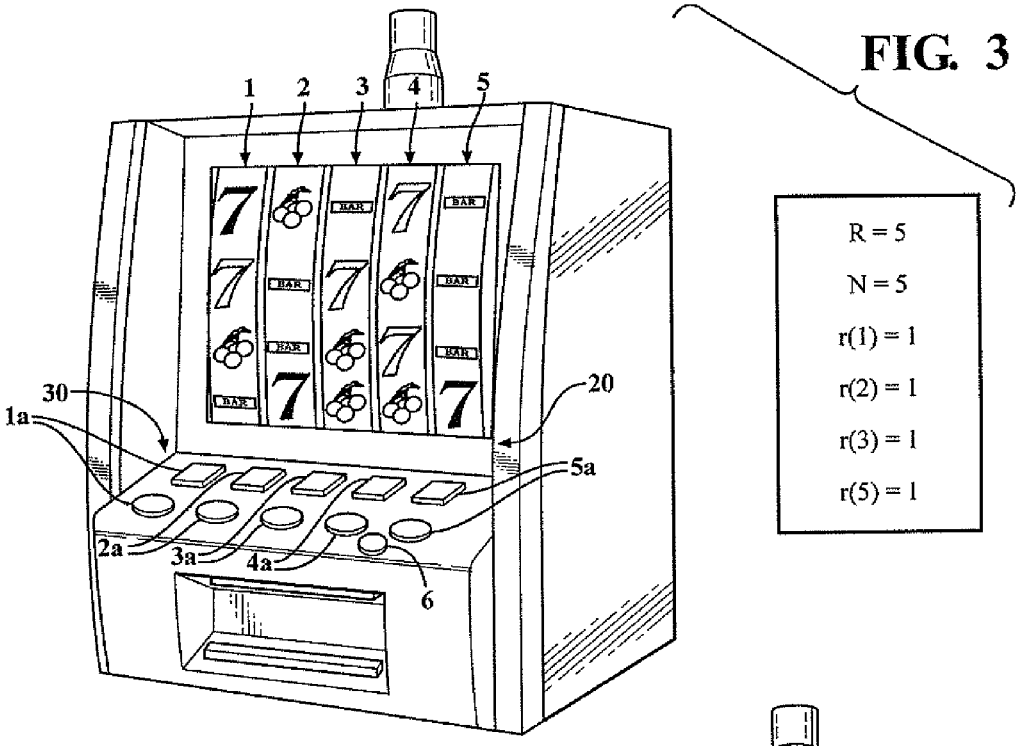
FIG. 3 is an illustration of the display screen and control panel for a five reel, five spin embodiment of the present invention.
Figure 4:
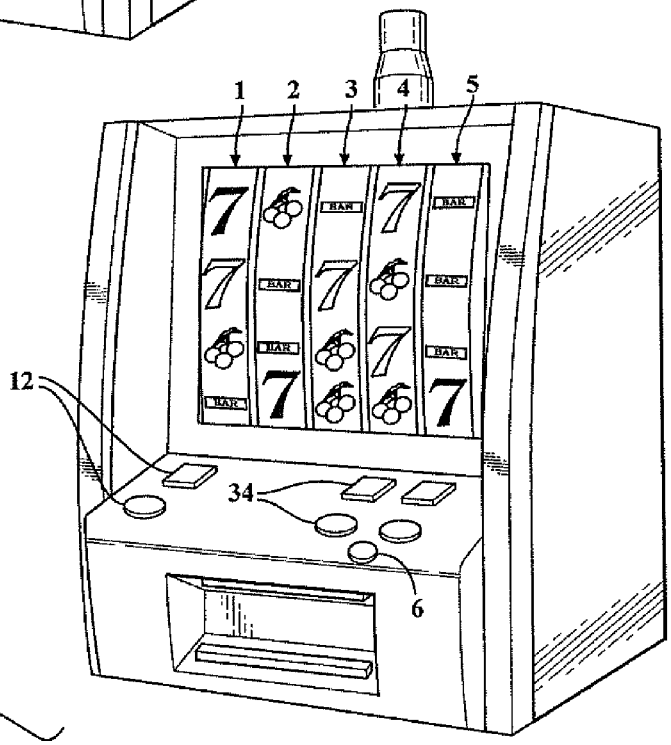
FIG. 4 is an illustration of the display screen and control panel for a five reel, three spin embodiment of the present invention.

FIGS. 3 and 4 show the display screen 20 and the player control panel 30. The display screen 20 displays a first reel 1, a second reel 2, a third reel 3, a fourth reel 4 and a fifth reel 5. The control panel 30 displays the BET setting buttons 1*a* or 12 for the first subset of reels, the BET setting buttons 2*a* or 34 for the second subset of reels, and this continues till the last subset of the N sets of reels, in the two given examples, N is equal to 5 and 3 respectively. The spin button 6 is also displayed on the player control panel 30. Only items that are relevant to this invention are shown in FIGS. 3 and 4. Items that exist in all standard machines are not shown in that drawing. These items include but are not limited to the following: the machine housing, coin/bill or ticket insertion slot, symbols or indicia on the reels, available credit display, win or pay display, message display and player card insertion slot.

After the performance of a credit input operation (such as inserting coins, bills or a ticket), a player sets the BET amount for the first subset of reels using 1*a* or 12, sets the BET amount for the second subset of reels using 2*a* or 34, and so on till the last N subset of reels. The BET amounts for each of the N wagers could be the same or different but are always within a minimum and maximum wagers set in the machine. The player then presses the spin button 6 to operate the machine and start a round of game.

Once spin button 6 is pressed, the first subset of reels r(1) spin, stop and display one or more symbols on the screen. Depending on the symbol(s) type and position displayed on the screen, wager placed on 1*a* or 12 is won or lost, and if won the winning amount is credited to the player. A predetermined condition may be imposed on the outcome of the first subset of reels so that the second subset of reels can spin. If that imposed condition, if any, is met, the second subset of reels spin, stop and display one or more symbols on the screen. Depending on the combined symbols displayed on the first and second subsets of reels, a wager placed on 2*a* or 34 is won or lost, and if won, the winning amount is credited to the player. At any spin n, if the imposed condition, if any, is not met, then subsequent spins of reels n+1, n+2 . . . N are not allowed and all wagers placed on these sets are credited to the player. The machine resets and a new round of game starts.

Another embodiment of this invention may be applied to a video or slot machine with R display areas or reels, R being equal or higher than 2.

Another feature of this invention is the employment of symbols commonly used in conventional machines. These include but are not limited to 7s, bells, dice numbers, roulette numbers, playing cards, cherries, bars, numbers, wild symbols, multipliers symbols, photos, animations, pictures or even "blanks". The same or different symbols could be used on all the reels or on the display areas of the machine. The number of different symbols is usually the same on all the reels or display areas, but in a few cases a symbol can't be displayed in a spin of a reel if the same symbol was displayed in the spin of a precedent reel.

Another aspect of this invention is that a condition may be imposed on the spin of a set of reels subsequent to the first spin. One of these conditions imposed may be to allow the reels of set number n to spin only if the wager placed on the precedent set of reels has been won (or lost). Another condition could be that all symbols displayed so far are all the same color, different color, belong to same or different categories, form specific combinations, etc.

Another aspect of this invention is the progressive increase in the payout from the first to second spin, from the second to third spin, etc.

These and other features, aspects and advantages of the present invention will become apparent to those skilled in the art and their application will make the slot and video machines much more attractive to the players and more beneficial to the casinos.

The invention claimed is:

1. A video slot machine, comprising:

a microprocessor;

a display screen;

player actuated inputs for establishing credits to make wagers;

an application program for the microprocessor operative to generate a display of the credits to the player with the credits being augmented when the player wins a wager and decremented when a wager is lost;

the application program being operative to generate images on said display screen of a set of rotatable reels which are divided into a plurality of subsets of reels, each reel having images of a plurality of symbols so that as the images of the reels rotate, different symbols are selected for display;

a player actuated switch connected to the microprocessor for transmitting a signal which initiates rotation of the reel images on the display screen;

the application program being operative to accept a sequence of credits from said player actuated inputs, each credit representing a wager associated with the activation of one of the subsets of reels in sequence;

the application program being operative upon a player actuating said switch to rotate in sequence the activated subsets of reels subsequent to the first subset of reels dependent upon a predetermined condition associated with the previous rotation in the sequence; and wherein if the predetermined condition is not met in one of the subset of rotations in the sequence, then the sequence of rotations is terminated, and the wagers on the rotations following said rotation in which the predetermined condition is not met are credited to the player.

2. The video slot machine of claim 1 wherein the application program being operative to establish each wager as being won or lost dependent on the symbol(s) displayed upon rotation of the subsets of reels associated with the said wager and the symbols displayed in the previous subsets of rotations in the sequence.

3. The video slot machine of claim 1 wherein the predetermined condition involving the symbols displayed upon rotation of the previous subsets of reel(s) in the set of rotations constitutes the wagers on all previous subsets having been won.

4. The video slot machine of claim 1 wherein upon winning a wager on a subset of reels the credits to the player per unit wager increase for each sequential rotation of a subset of reels in the series.

5. The video slot machine of claim 1 wherein the application program is operative to establish each wager as being won or lost dependent on the symbol(s) displayed upon rotation of the subset of reels associated with the said wager and the symbols displayed in the previous subsets of rotations in the sequence.

* * * * *